US011143191B2

(12) United States Patent
Schofield

(10) Patent No.: US 11,143,191 B2
(45) Date of Patent: Oct. 12, 2021

(54) DRAG PUMP AND A SET OF VACUUM PUMPS INCLUDING A DRAG PUMP

(71) Applicant: Edwards Limited, Burgess Hill (GB)

(72) Inventor: Nigel Paul Schofield, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 8 days.

(21) Appl. No.: 16/646,861

(22) PCT Filed: Sep. 19, 2018

(86) PCT No.: PCT/GB2018/052678
§ 371 (c)(1),
(2) Date: Mar. 12, 2020

(87) PCT Pub. No.: WO2019/058117
PCT Pub. Date: Mar. 28, 2019

(65) Prior Publication Data

US 2020/0271118 A1 Aug. 27, 2020

(30) Foreign Application Priority Data

Sep. 20, 2017 (GB) ..... 1715151

(51) Int. Cl.
*F04D 19/04* (2006.01)
*F04D 17/16* (2006.01)
(Continued)

(52) U.S. Cl.
CPC ..... *F04D 19/044* (2013.01); *F04D 17/168* (2013.01); *F04D 23/00* (2013.01);
(Continued)

(58) Field of Classification Search
CPC .... F04D 17/168; F04D 19/042; F04D 19/044; F04D 19/046; F04D 23/008; F04D 29/048; F05B 2280/1071
See application file for complete search history.

(56) References Cited

U.S. PATENT DOCUMENTS 4,929,151 A * 5/1990 Long ..... F04D 29/584 415/177
6,446,651 B1 9/2002 Abbel
(Continued)

FOREIGN PATENT DOCUMENTS

CN 102472288 A 5/2012
CN 204224700 U 3/2015
(Continued)

OTHER PUBLICATIONS

British Examination Report dated Feb. 21, 18 and Search Report dated Feb. 20, 2018 for corresponding British Application No. GB1715151.5.
(Continued)

*Primary Examiner* — Woody A Lee, Jr.
*Assistant Examiner* — Brian O Peters
(74) *Attorney, Agent, or Firm* — Theodore M. Magee; Westman, Champlin & Koehler, P.A.

(57) ABSTRACT

A drag pump for pumping gas and a set of vacuum pumps including the drag pump are disclosed. The drag pump comprises: a rotor configured to rotate within a stator component and to drive a gas to be pumped from a gas inlet to a gas outlet; magnetic bearings for rotatably mounting the rotor within the pump; wherein at least a portion of the rotor and stator component configured to contact the gas to be pumped are configured for operation at temperatures above 130° C.

15 Claims, 2 Drawing Sheets

(51) Int. Cl.

| | |
|---|---|
| ***F04D 23/00*** | (2006.01) |
| ***F04D 27/02*** | (2006.01) |
| ***F04D 29/02*** | (2006.01) |
| ***F04D 29/58*** | (2006.01) |

(52) U.S. Cl.
CPC ..... *F04D 27/02* (2013.01); *F04D 29/023* (2013.01); *F04D 29/5853* (2013.01); *F05B 2240/51* (2013.01); *F05B 2260/231* (2013.01); *F05B 2280/1071* (2013.01)

(56) References Cited

U.S. PATENT DOCUMENTS

| | | | | |
|---|---|---|---|---|
| 7,866,940 | B2 * | 1/2011 | Stones | F04D 19/042 415/55.6 |
| 2003/0097985 | A1 | 5/2003 | Kitazawa | |
| 2004/0076510 | A1 | 4/2004 | Favre-Felix et al. | |
| 2005/0025640 | A1 | 2/2005 | Sekiguchi et al. | |
| 2005/0047904 | A1 | 3/2005 | Rival | |
| 2005/0186099 | A1 | 8/2005 | Huntley | |
| 2014/0050607 | A1 * | 2/2014 | Kabasawa | F04D 29/526 417/423.14 |
| 2015/0275914 | A1 | 10/2015 | Tsutsui | |

FOREIGN PATENT DOCUMENTS

| | | | |
|---|---|---|---|
| CN | 104520591 | A | 4/2015 |
| EP | 0643227 | A1 | 3/1995 |
| EP | 1039137 | A2 | 9/2000 |
| JP | H08338394 | A1 | 12/1996 |
| JP | H10288189 | A1 | 10/1998 |
| JP | 2002115692 | A1 | 4/2002 |
| JP | 2003214378 | A1 | 7/2003 |
| JP | 2004116319 | A | 4/2004 |
| JP | 2005240952 | A1 | 9/2005 |
| JP | 2005307859 | A1 | 11/2005 |
| JP | 2017002856 | A1 | 1/2017 |
| WO | 2004055375 | A1 | 7/2004 |
| WO | 2004055377 | A1 | 7/2004 |
| WO | 2005033522 | A1 | 4/2005 |

OTHER PUBLICATIONS

British Examination Report dated Mar. 13, 2019 and Search Report dated Mar. 12, 2018 for corresponding British Application No. GB1815265.2.

PCT Notification of Transmittal of the International Search Report and the Written Opinion of the International Searching Authority, or the Declaration dated Jan. 23, 2019, PCT Search Report and Written Opinion dated Jan. 23, 2019 for corresponding PCT Application No. PCT/GB2018/052678.

First Office Action dated Oct. 28, 2020 and Search Report dated Oct. 20, 2020 for corresponding Chinese Application Serial No. CN201880061402.9, 13 pages.

European Communication dated May 12, 2021 and European Search Report dated May 4, 2021 for corresponding European application Serial No. 18778981.3, 17 pages.

* cited by examiner

DRAG PUMP AND A SET OF VACUUM PUMPS INCLUDING A DRAG PUMP

CROSS-REFERENCE OF RELATED APPLICATION

This application is a Section 371 National Stage Application of International Application No. PCT/GB2018/052678, filed Sep. 19, 2018, and published as WO 2019/058117 A1 on Mar. 28, 2019, the content of which is hereby incorporated by reference in its entirety and which claims priority of British Application No. 1715151.5, filed Sep. 20, 2017.

FIELD

The invention relates to the field of drag pumps and in particular illustrative examples to drag pumps for reducing the pressure at the exhaust of a turbomolecular pump. The invention also relates to the field of sets of vacuum pumps for providing a vacuum in a semiconductor processing chamber.

BACKGROUND

Turbomolecular pumps are used to provide the high vacuums required for semiconductor fabrication. Semiconductor processes increasingly require pumps and pumping lines to be maintained at high temperatures to prevent process by-products from condensing. The risk of condensates forming increases as the uses flow through the pumping system and pressures increase.

Turbomolecular pumps are expensive pumps designed for use in clean rooms and for operation at high tip speeds. Their rotors are rotatably mounted on magnetic bearings to avoid the need for lubrication and reduce vibrations and this makes them suitable for clean room operation. However, turbomolecular pumps do not operate well at higher pressures and so generally these pumps comprise some form of hacking pump stages to decrease the pressure at the exhaust of the turbo stages. These backing stages generally comprise a drag stage downstream of the turbomolecular stages and integrated within the pump and mounted on the same shaft. The pump may also have additional backing pump(s) remote from the cleanroom.

Where the turbomolecular pump has a drag pump backing stage, the rotor of this stage is formed from aluminium as a rotor integral with the turbomolecular rotor, the rotors being machined in one piece. Aluminium is selected as it has a high strength to weight ratio which is important for the high tip speed operation of the turbomolecular pump.

The backing pumps are not suitable for clean room operation and are located remote from the clean room and are connected via pumping lines or pipes to the clean room pump. In order to avoid or at least reduce condensation of process by-products these connecting pipes should be maintained at high temperatures.

As noted previously turbomolecular pumps are generally made from Aluminium which loses much of its strength above 130° C. This limits turbo pump operation to 130° C. which may not be sufficient to prevent condensation in the exhaust stage of the pump. The exhaust stage is generally a drag stage, usually a Holweck type stage. The turbo stages operate at a pressure that is sufficiently low so as not to have a condensation problem at 130° C. The drag stages however can sometimes condense process by-product and this can lead to blockage.

A pipe connection, that is often quite long, say 10 m, and has a relatively large diameter, say 100 mm, is used to connect the turbomolecular pump within the clean room to a roots blower and dry backing pump remote from the clean room. This pipe and both the roots blower and backing pump are heated to high temperatures, typically 160° C. to avoid condensation. Purge gas is also introduced into the backing pump to dilute the gas stream and reduce condensation problems.

Large diameter pipes are costly to buy and install and costly to heat.

It would be desirable to provide a pump suitable for clean room operation and resistant to condensation of process by-products and which is not unduly expensive The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides a drag pump for pumping gas, said drag pump comprising: a rotor configured to rotate within a stator component; magnetic bearings for rotatably mounting said rotor using magnetic levitation within said pump; wherein at least the portion of said rotor and stator component configured to contact said gas to be pumped are configured for operation at temperatures above 130° C. and said rotor is fabricated at least partially from steel.

The inventor of the present invention recognised that the problem with condensates in the drag pump stage of a high vacuum pump might be addressed if this stage was removed from the turbomolecular pump and configured as a separate pump. This would allow the pump to be manufactured from a greater selection of materials and as such would allow it to be configured for higher temperature operation. There is however, a technical prejudice against doing this as it requires an additional shaft and motor. Furthermore, in order for the two pumps to operate effectively the pumping lines required for connecting the pumps at these low pressures would need to have significant diameters and be heated to reduce condensation. Furthermore, if the separate pump were to be located outside of the clean room as is conventional for separate backing pumps then these pumping lines or pipes would need to have a significant length, increasing both the piping and heating costs. However, the inventor also recognised that in order for such a pump to be effective and for the costs associated with pumping lines and heating of such lines to be reduced, the pump could be configured to be suitable for clean room operation by providing it with magnetic bearings. The magnetic bearings allow the pump to be operated without lubrication and with reduced vibrations.

Thus, a separate drag pump that is suitable for use at higher temperatures and within a clean room is provided, which pump is therefore ideal as a backing pump for a high vacuum turbomolecular pump.

In some embodiments, said portion of said rotor and stator component configured to contact said gas to be pumped are configured for operation at temperatures above 150° C., preferably between 160° C. and 180° C.

Keeping the temperatures above 150° C. and in some embodiments between 160° C. and 180° C. allows the pump to operate effectively with semiconductor process gases at higher pressures allowing the pipes to the backing pumps to be reduced in diameter.

In some embodiments, said rotor is fabricated at least partially from precipitation hardened stainless steel. In some embodiments the majority of the rotor is formed from steel. In some embodiments the stator is also fabricated from precipitation hardened stainless steel.

The rotor may be fabricated partially from steel that can operate at high temperatures, and one steel that is particularly effective for forming a rotor operable at higher temperatures is precipitation hardened steel. Steel is more resistant to high temperatures than aluminium and is readily available and has suitable mechanical properties. Its strength to weight properties are not as good as those of aluminium, however as it is operating at a higher pressure than the turbomolecular pump and is not mounted on the same shaft, then it can be operated at a lower speed of rotation enabling steel to be used for its fabrication.

In some embodiments, said pump comprises a heater configured to heat said drag pump such that said at least a portion of said rotor and stator component configured to contact said gas to be pumped are maintained at a temperature above 130° C. during operation.

In order for the process gases to be maintained at a temperature where process by-products do not condense then a heater may be provided to maintain the temperature of the stator and rotor above 130° C. and preferably above 150° C. and in some embodiments between 160-1.80° C. These temperatures do not weaken the steel components and are sufficient to maintain the process gas by-products above their condensation temperatures at the pressure of operation of the drag pump.

In some embodiments, said drag pump further comprises at least one thermal insulating member configured to thermally isolate said rotor and stator from a region comprising said motor of said drag pump.

Although the rotor and stator may be configured to operate at this higher temperature, the motor and bearings supporting the shaft should be protected from the higher temperature of operation in order to avoid damaging them and decreasing their lifetime. In order to do this one or more thermal insulating members may be used as thermal breaks to provide thermal isolation between these components.

In some embodiments, said at least one thermal insulating member comprises a thermal insulating member between said stator component and base of said pump, and a thermal insulating member between said rotor and a drive shaft of said rotor.

The stator component may be mounted on the base of the pump and a thermal insulating member may be used between these two components to reduce thermal flow between them. This thermal insulating member may have a number of forms and may be for example a ceramic gasket. Another thermal path is between the rotor and the drive shaft and a thermal insulating member may be placed between these two components to impede thermal conduction in this region.

Additionally, a thermal shield may be placed between the rotor and stator component and the motor region of the pump.

In some embodiments, said drag pump comprises at least one drag stage and at least one regenerative stage.

Although the drag pump may be formed of only one or more drag stages, in some embodiments it additionally comprises at least one regenerative stage which is generally located as the final stage(s) in this pump. A regenerative pumping stage sometimes called a side channel or peripheral flow pumping stage can operate effectively at a higher pressure than most drag pumps and thus, by providing this at a later stage in the drag pump a drag pump that operates to a higher exhaust pressure can be provided. This higher exhaust pressure may allow one of more of the downstream backing pumps not to be required such that a number of pumps in the vacuum pump set can be reduced and the overall cost of the set of pumps correspondingly reduced. Furthermore, by providing a higher pressure at the exhaust stage the cross section of the pipes required to transmit the gas from this pump to subsequent hacking pumps is lower. Given that the subsequent hacking pumps may be remote from this pump as they are generally not within the clean room such a reduction in size can be a significant cost saving.

In some embodiments, a rotor of said regenerative stage is formed at least partially from steel. In some embodiments a majority of said rotor is formed from steel.

Regenerative pumps are generally pumps that operate with a high tip speed and as such are conventionally made from aluminium. The use of a regenerative stage as the final stage of the drag pump allows it to operate with a higher exhaust pressure.

Although, the one or more drag stages of the drag pump may comprise a number of different configurations, in some embodiments they comprise one or more Holweck pump stages or one or more Siegbahn pump stages or a combination of one or more of each.

In some embodiments, said at least one regenerative stage and said at least one drag stage are mounted on a same drive shaft.

Mounting the regenerative stage(s) and the drag stage(s) on a same drive shaft allows a simple and lower cost design of pump which uses the same drive motor and magnetic bearings for each of the pump stages.

In some embodiments, the pump comprises at east two drag stages arranged in series.

Although as noted above the pump can be formed as a single drag stage, in many embodiments it comprises two or more drag stages arranged in series allowing a larger pressure differential across the pump. A pump that can provide an inlet at a high vacuum and therefore be an effective backing pump for a turbomolecular pump and yet have an increased pressure at the outlet allows the pump to be connected to lower diameter pipes and allows a reduction in the capacity of, and/or number of, additional backing pumps required.

In some embodiments, said drag pump comprises at least two drag stages arranged in parallel, each operable to receive gas from a respective gas input.

Providing a drag pump operable to operate at higher temperatures may require the speed of operation to be reduced in order to allow a material such as steel to be used for at least some of the components in contact with the gas. Such a material may not have the strength to weight ratio required for very high tip speed operations and as such in order to provide sufficient gas flow to support a turbo molecular pump which may operate at such speeds it may be advantageous if drag stages are arranged in parallel with each stage operable to receive gas from a respective gas input. In this way, the gas flow rate can be increased and an effective pump provided.

In some embodiments, the drag pump comprises a rotor blade adjacent to said input, said rotor blade comprising a turbo molecular pump stage, having blades angled to push gas into said pump.

As noted previously, providing a sufficient gas flow at perhaps a lower rotational speed and providing an effective inlet for admitting the gas to the pump can be a challenge.

One way of improving gas flow into the pump may be to provide one or more stages of a turbomolecular pump on the input of the pump. A turbomolecular pump stage has blades that are angled to push the gas into the pump and help gas flow at the inlet.

In general there may be a single turbomolecular pump stage although in some embodiments there may be 2 or 3 of them. The rotor of this stage is configured for operation at the temperature of the pump and may be formed at least partially of steel.

In some embodiments, said drag pump is configured for operation between 0.1-0.5 mbars at an inlet and 0.5-3 mbars at an outlet.

The drag pump is configured for operation such that it is suitable as a direct backing pump for a turbomolecular pump and yet provides an outlet pressure that is high enough to avoid the need for high diameter pipes and to reduce the backing pump requirements and perhaps allow a single primary pump rather than the conventional roots blower and primary pump. In this way the overall cost of the pumping system can be reduced.

In some embodiments, said drag pump comprises an inlet configured to connect to a pipe of a diameter between 80 and 160 mm.

In some embodiments, said drag pump comprises an exhaust configured to connect to a pipe of a diameter between 30 to 60 mm.

As noted previously, the pipe connecting the drag pump to the turbomolecular pump may need to have a large diameter and as such a large inlet is provided. The higher pressure of the outlet allows a smaller diameter pipe and therefore a smaller outlet. As the drag pump is configured to be suitable for operational in a clean room and has magnetic bearings the larger diameter pipe may be significantly shorter than the smaller diameter pipe so that this arrangement is a cost effective arrangement.

In some embodiments, said drag pump is configured for operation as a backing pump for at least one high vacuum turbomolecular pump.

In some embodiments, said drag pump is configured for operation as a backing pump for two or more high vacuum turbomolecular pump.

By providing the drag pump as a separate pump an additional set of bearings and a motor is required. Additional costs for this may be offset by reducing the need for further backing pumps and allowing smaller pipes and lower heating requirements. A further way of reducing pump costs is to share the drag pump between two or more high vacuum turbomolecular pumps and suitable sizing and parameters of operation may make this possible.

A second aspect of the present invention provides set of pumps for providing a high vacuum within a semiconductor processing chamber, said set of pumps comprising: at least one high vacuum turbomolecular pump for evacuating a process chamber; and a drag pump comprising: a rotor configured to rotate within a stator component and to drive a gas to be pumped from a gas inlet to a gas outlet; magnetic bearings for rotatably mounting said rotor using magnetic levitation within said pump, said drag pump being connected to an exhaust of said at least one turbomolecular pump via at least one first conduit.

Forming a drag pump such that the rotor is mounted using magnetic bearings makes it suitable for mounting in a clean room and thus, the pump can be located close to but separate from the turbomolecular pump. This allows it to be used as an effective backing pump at low pressures while being separate from the turbomolecular pump. This allows it to operate at a different temperature, at different rotational speeds and be formed of different materials to the turbomolecular pump.

In some embodiments, said drag pump comprises a drag pump according to a first aspect as described in the paragraphs above.

In some embodiments, said set of pumps comprises valve means configured to selectively connect or isolate an inlet of said drag pump with said vacuum chamber via at least one further conduit and to isolate or connect said inlet of said drag pump with said exhaust of said turbomolecular pump.

Having the drag pump as a separate pump allows it to be operated separately to the turbomolecular pump. Thus, with the use of appropriate conduits and valves the drag pump can be used to evacuate the vacuum chamber directly and provide an initial vacuum prior to connecting the turbomolecular pump to the chamber to evacuate to a higher vacuum with the drag pump connected as a backing pump. In this way a pumping set is provided that is suitable for operation within a clean room and can evacuate a chamber from higher pressures than would be the case were the pump a conventional combined turbomolecular and drag pump.

In some embodiments, said set of pumps further comprises a backing pump connected to an exhaust of said drag pump by a second pipe; wherein said at least one first pipe is shorter and has a larger diameter than said second pipe.

As noted previously, as the drag pump increases the pressure of the gas output and therefore the pipe connecting it to further backing pumps can be of a smaller diameter to the pipe connecting the drag pump to the turbomolecular pump. Furthermore, as the drag pump is configured for operation within a clean room this pipe can be shorter than the large diameter pump therefore saving costs.

Further particular and preferred aspects are set out in the accompanying independent and dependent claims Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Figure 1:
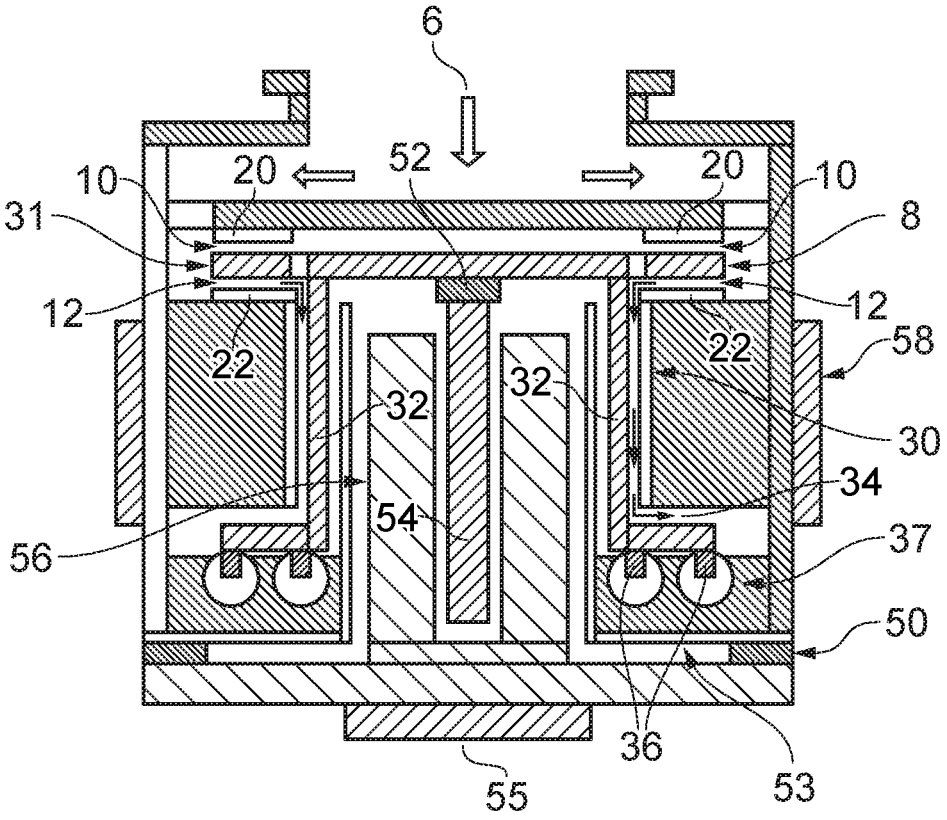
FIG. 1 illustrates a drag pump according to an embodiment.

Before discussing the embodiments in any more detail, first an overview will be provided.

Embodiments provide a drag pump for use in a system of vacuum pumps to enable the pumping of process gas streams that contain condensable products. This is achieved by heating the different pumps to temperatures sufficiently high to avoid condensation. A new high temperature drag pump with a regenerative exhaust stage is used to back a turbo pump. The new pump may use a rotor with a steel construction to withstand higher temperatures and stress.

Embodiments also provide a set of pumps comprising a separate drag pump and turbomolecular pump for use in generating and maintaining a vacuum in a vacuum chamber of a semiconductor processing system.

In embodiments a turbo pump is used with no integrated drag stage. This turbo pump can be operated up to a temperature of 130° C. and does not suffer from condensation. Above this temperature aluminium loses its strength. A second pump, of a new design, is mounted in close proximity to the turbo pump, and in some embodiments has both drag stages and regenerative stages. This pump has a rotor fabricated from steel sections to withstand a higher operating temperature, typically 150° C. to 180° C.

To enable the pump to be operated effectively at high temperatures there may be an arrangement of thermal breaks to reduce the heat flow to the motor and bearing components. One thermal insulating member may be located at the top of the drive spindle to limit heat flow from the top flange of the rotor to the drive spindle. A second thermal insulating member may be located between the hot pump stator and the cooler base and drive column. A heat shield may be used to reduce heat transfer from the rotor to the central drive column.

When used in a vacuum system for a semiconductor process chamber, a long pipe connects this pump to a dry backing pump. The roots blower used in such conventional backing pump systems is not required as the exhaust pressure of the new drag/regenerative pump is sufficiently high not to need the booster. The pipe can be of a relatively small diameter compared to that conventionally used, say 40 to 50 trim diameter as opposed to 100 mm diameter. This saves cost and heating power.

This pump could be used to back two or more turbo pumps in applications with a low flow.

The turbo pump can be made more compact due to the lack of drag stage.

The On Tool Booster or drag pump is a magnetically levitated machine, with a similar magnetic bearing system to the turbo pumps used in semiconductor processing.

The rotor construction is from high strength steel components. A typical design would use a cylinder to support a range of Siegbahn or Holweck drag stages and one or more regenerative stages at the exhaust. The cylinder itself is supported on a top flange that connects to the central drive shaft. The top flange may be used to provide a dual inlet Siegbahn disk.

One or more steel turbo stages could be added to the inlet to increase speed at low pressure and help with gas admission, however it is considered that a separate turbo pump would generally be used and extra inlet turbo stages would not be required.

In a typical pump the tip speeds would be less than for a pump made from aluminium due to the reduced ratio of strength to weight of steel compared to aluminium. To counter this the inlet drag stage can be 2 or more parallel stages, such as 2. Siegbahn stages as shown in FIG. 1. This would be followed by further Siegbahn or Holweck stages in series. Finally a regenerative section, consisting typically of 2 stages is provided.

FIG. 1 shows a drag pump according to an embodiment. The drag pump has an inlet 6 for admitting gas which has been output from a turbomolecular pump. The gas flows into two parallel Siegbahn stages 8. Siegbahn stages 8 comprise helical paths arranged around a disk, a rotor 31 pushing gas along these helical paths. In this embodiment there are two parallel Siegbahn stages in that there are two sets of helical paths above and below the rotor and the rotation of the rotor pushes the gas along each of them. Thus the gas is input into two inputs 10, 12 one above the other and the helical paths in the stators 20 and 22 form paths for the gas to be pushed along by the rotating rotor 31.

The gas then passes into the subsequent stage which is a Holweck stage. The Holweck stage has helical paths on stator component 30 and the gas is driven by the vertical portion of die rotor 32 along these paths towards an outlet of this stage 34 and into the regenerative stages of the pump.

The inlet to the regenerative stages 37 is on a side wall of these stages and is not shown. Rotation of the blades 36 extending from the rotor 31, 32 drives the gas around the circular passage of the outer regenerative stage and into the inner regenerative stage and then out through an exhaust.

Drive shaft 54 mounts the rotor and is itself mounted on magnetic bearings 56 such that it is magnetically levitated during operation and does not require oil lubrication and produces very few vibrations.

There is a heater 58 for heating the pump and this provides heat to the stator and rotor components which contact the pumped gas and maintains them at temperatures greater than 130° C. so as to avoid, or at least reduce condensation of process by-products. There are thermal breaks 50, 52 between the base of the pump and the stator and between the drive shaft and rotor respectively. These help maintain the drive shaft and other motor components at temperatures below the temperature of the rotor and stator. There is also a heat shield 53 protecting the drive shaft and motor from the stator and rotor.

In this embodiment, the Holweck stage is a single stage, in some embodiments it may be multiple stages perhaps two on either side of the vertical rotor cylinder such that there are two helical stator components through which gas is directed by rotation of the rotor. Cooling 55 is provided to the magnetic bearing assembly 56.

Figure 2A:
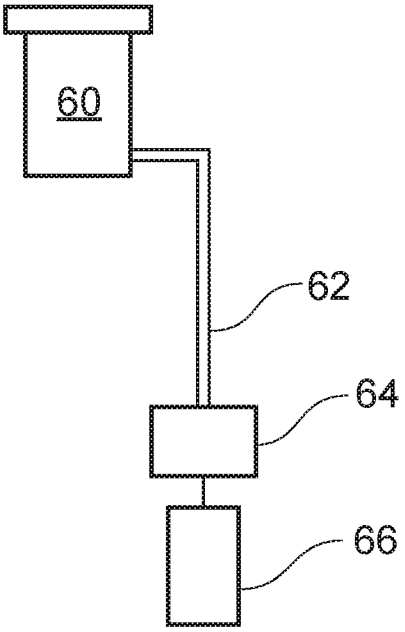
FIG. 2*a* illustrates a set of vacuum pumps for evacuating a high vacuum semiconductor process chamber according to the prior art.

FIG. 2 shows the arrangement of this pump within a set of pumps for evacuating a semiconductor chamber in a fabrication plant. FIG. 2*a* shows a prior art set of pumps where the drag pump is integral with the turbomolecular pump 60 and operates at the lower temperature of operation of this pump and has a low exhaust pressure to avoid condensation of by-products. This set of pumps has a long and wide diameter pipe 62 to exhaust the low pressure gases towards the booster roots blower pump 64 and dry primary pump 66 located remotely from the clean room.

Figure 2B:
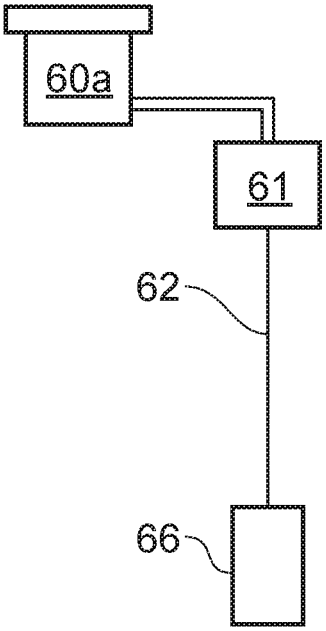
FIG. 2*b* illustrates a set of vacuum pumps for evacuating a high vacuum semiconductor process chamber according to an embodiment.

FIG. 2*b* shows a different arrangement comprising a drag pump 61 according to an embodiment. In this arrangement the drag pump 61 which comprises both drag pump stages and one or more regenerative stages is configured as a separate pump to the turbomolecular pump 60*a*. It is configured with magnetic bearings and as such can be located within the clean room and thus requires a shorter pipe between it and the turbomolecular pump. Furthermore, as it is a separate pump it can be configured of a different material to the turbomolecular pump 60*a* allowing it to operate at higher temperatures and therefore at a higher pressure. The exhaust gas output by the drag pump is therefore at a significantly higher temperature and pressure than that output by the turbo/drag pump of the prior art. Thus, a smaller diameter pipe with fewer heating requirements can be used to connect this pump to the further backing pumps. Furthermore, owing to the higher pressure at the output of the separate drag pump the roots blower pump used in the conventional system may be dispensed with.

Thus, although it might be considered to add costs to provide the drag stage as a separate pump as it requires an additional motor and magnetic bearings, it allows a higher temperature and therefore pressure of operation and thus, it allows for smaller diameter connecting pipes with lower heat requirements. Furthermore, in some embodiments it may allow for one or more of the backing pumps such as the roots blower pump of the conventional backing pump system to be dispensed with.

Figure 3:
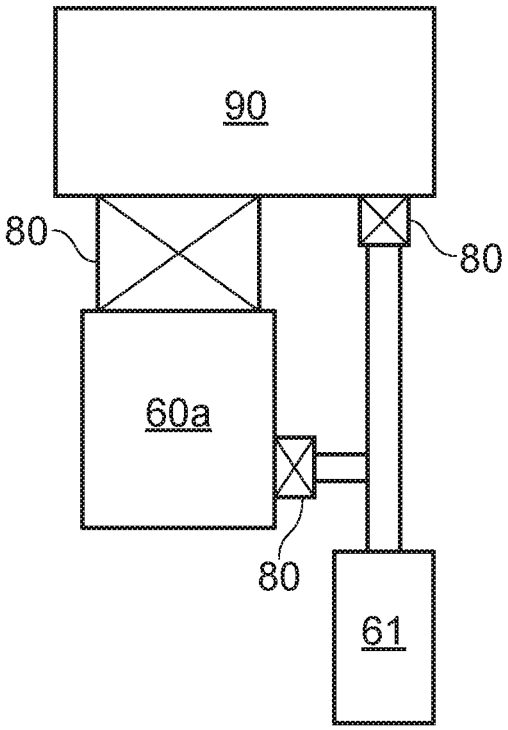
FIG. 3 schematically shows a set of vacuum pumps according to a further embodiment.

FIG. 3 shows a set of pumps for a further embodiment. In this embodiment there is a turbomolecular pump 60*a* configured to evacuate vacuum chamber 90. There is also a drag pump 61 that is connected via a conduit and valve 80 to the exhaust of the turbomolecular pump 60*a* and via a further conduit and valve 80 to the vacuum chamber 90. There is a valve 80 between the vacuum chamber 90 and turbomolecular pump 60*a*.

The valves may be set such that the drag pump is connected to the vacuum chamber and the turbomolecular pump is isolated from it. The valves may also be set so that the chamber is isolated from direct connection with the drag pump but is connected with the turbomolecular pump and the turbomolecular pump exhaust is connected to the drag pump so that it is backed by the drag pump.

In effect by providing the drag pump 61 as a pump that is separate from the turbomolecular pump 60*a* the drag pump can be used to evacuate the chamber independently from the turbomolecular pump. Thus, it can be used to evacuate the chamber when it is at higher pressures than would be the case were the turbo pump acting alone. When the chamber pressure falls to a certain value, the valves can be switched and the turbo pump 60*a* backed by drag pump 61 can be used to create and maintain a higher vacuum.

Although the drag pump may be made of a different material to the turbo pump and one resistant to higher temperatures, in embodiments of the set of pumps may be formed of a similar material to the turbo pump.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A drag pump for pumping gas, said drag pump comprising:

a rotor configured to rotate within a stator component and to drive a gas to be pumped from a gas inlet to a gas outlet;

magnetic bearings for rotatably mounting said rotor using magnetic levitation within said pump; and at least one thermal break between a drive shaft and said rotor mounted thereon;

wherein at least the portion of said rotor and stator component configured to contact said gas to be pumped are configured for operation at temperatures above 130° C. and said rotor is fabricated at least partially from steel.

2. The drag pump according to claim 1, wherein the portion of said rotor and stator component configured to contact said gas to be pumped are configured for operation at temperatures above 150° C.

3. The drag pump according to claim 1, wherein said drag pump comprises a heater configured to heat said drag pump such that said rotor and stator component configured to contact said gas to be pumped are maintained at a temperature above 130° C. during operation.

4. The drag pump according to claim 1, wherein said drag pump comprises at least one drag stage and at least one regenerative stage.

5. The drag pump according to claim 4, wherein a rotor of said regenerative stage is formed at least partially from steel.

6. The drag pump according to claim 4, wherein said at least one drag stage comprises at least one of a Holweck pump stage and a Siegbahn pump stage.

7. The drag pump according to claim 4, wherein said at least one regenerative stage and said at least one drag stage are mounted on a same drive shaft.

8. The drag pump according to claim 4, comprising at least two drag stages arranged in series.

9. The drag pump according to claim 1, wherein said drag pump comprises at least two drag stages arranged in parallel, each operable to receive gas from a respective gas input and/or wherein the drag pump comprises a rotor blade adjacent to said gas inlet, said rotor blade comprising a turbomolecular pump stage, having blades angled to push gas into said pump and/or wherein said drag pump is configured for operation between 0.1-0.5 mbars at an inlet and 0.5-3 mbars at an outlet and/or wherein said drag pump comprises an inlet configured to connect to a pipe of a diameter between 80 and 160 mm.

10. The drag pump according to claim 1, wherein said drag pump comprises an exhaust outlet configured to connect to a pipe of a diameter between 30 to 60 mm.

11. The drag pump according to claim 1, wherein said drag pump is configured for operation as a backing pump for at least one high vacuum turbomolecular pump.

12. A set of pumps for providing a high vacuum within a semiconductor processing chamber, said set of pumps comprising:

at least one high vacuum turbomolecular pump for evacuating a process chamber; and a drag pump comprising:

a rotor configured to rotate within a stator component and to drive a gas to be pumped from a gas inlet to a gas outlet;

magnetic bearings for rotatably mounting said rotor using magnetic levitation within said pump, said drag pump being connected to an exhaust of said at least one turbomolecular pump via at least one first pipe;

wherein said set of pumps comprising valve means configured to selectively connect or isolate an inlet of said drag pump with said vacuum chamber via at least one further pipe and to isolate or connect said inlet of said drag pump with said exhaust of said turbomolecular pump.

13. The set of pumps according to claim 12, wherein said drag pump is configured for operation as a backing pump for at least one high vacuum turbomolecular pump and said drag pump comprises:

wherein at least the portion of said rotor and stator component configured to contact said gas to be pumped are configured for operation at temperatures above 130° C. and said rotor is fabricated at least partially from steel.

14. The set of pumps according to claim 12, further comprising:

a backing pump connected to an exhaust of said drag pump by a second pipe; wherein said at least one first pipe is shorter and has a larger diameter than said second pipe.

15. The set of pumps according to claim 12, wherein said at least one high vacuum turbomolecular pump is configured to operate at lower temperatures than said drag pump.

* * * * *